US005629853A

United States Patent [19]

Ogawa et al.

[11] Patent Number: 5,629,853

[45] Date of Patent: May 13, 1997

[54] FUEL INJECTION CONTROL SYSTEM FOR INTERNAL COMBUSTION ENGINES

[75] Inventors: Ken Ogawa; Kei Machida, both of Wako, Japan

[73] Assignee: Honda Giken Kogyo Kabushiki Kaisha, Tokyo, Japan

[21] Appl. No.: 398,082

[22] Filed: Mar. 3, 1995

[30] Foreign Application Priority Data

Mar. 9, 1994 [JP] Japan ..... 6-065518

[51] Int. Cl.[6] ..... F02D 41/04; F02D 41/26

[52] U.S. Cl. ..... 364/431.051; 364/431.04; 364/431.061; 123/480; 123/492; 123/571

[58] Field of Search ..... 364/431.05, 431.03, 364/431.04, 431.06, 431.12; 123/480, 492, 493, 478, 520, 585, 486, 571, 73 C, 90.15, 681, 672

[56] References Cited

U.S. PATENT DOCUMENTS

| | | | |
|---|---|---|---|
| 4,359,993 | 11/1982 | Carlson | 123/492 |
| 4,388,906 | 6/1983 | Sugiyama et al. | 123/480 |
| 4,852,538 | 8/1989 | Nagaishi | 123/493 |
| 4,922,877 | 5/1990 | Nagaishi | 364/431.05 |
| 4,987,890 | 1/1991 | Nagaishi | 123/492 |
| 5,080,071 | 1/1992 | Minamitani et al. | 123/478 |
| 5,215,061 | 6/1993 | Ogawa et al. | 123/520 |

FOREIGN PATENT DOCUMENTS

| | | |
|---|---|---|
| 3-23339 | 1/1991 | Japan . |
| 3-59255 | 9/1991 | Japan . |

*Primary Examiner*—Kevin J. Teska
*Assistant Examiner*—Tan Q. Nguyen
*Attorney, Agent, or Firm*—Armstrong, Westerman, Hattori, McLeland & Naughton

[57] ABSTRACT

A fuel injection control system for an internal combustion engine comprises an ECU which calculates a direct supply ratio and a carry-off ratio, and detects a predetermined operating condition of the engine in which an increased amount of fuel is to be supplied to the engine. When the predetermined operating condition is detected, a plurality of fuel injection amounts to be sequentially injected by at least one fuel injection valve are calculated based on operating conditions of the engine, the direct supply ratio and the carry-off ratio. Then, an amount of fuel adhering to the intake system of the engine is calculated based on the total sum of the calculated plurality of fuel injection amounts, as well as on the calculated direct supply ratio and the calculated carry-off ratio. At least one of the calculated plurality of fuel injection amounts is corrected based on the calculated amount of fuel adhering to the intake system. Then, at least one fuel injection valve is controlled to sequentially carry out a plurality of fuel injections in one operating cycle of the engine, based on the calculated plurality of fuel injection amounts including the at least one thereof corrected.

6 Claims, 9 Drawing Sheets

#1COMPRESSION STROKE
#1EXPLOSION STROKE
#1EXHAUST STROKE
#1SUCTION STROKE
#1COMPRESSION STROKE
#1EXPLOSION STROKE
180°
90°
45°
CRME
CYL SIGNAL PULSE
TDC-DISCRIMINATING SIGNAL PULSE
CRK SIGNAL PULSES (#1CYL STAGE NO)
Flcal (#1~#4CYL)
SINJ(K)
FUEL INJECTION VALVE(#1INJ)
CLOSE
OPEN
IAlcal (#1INJ)
TWPcal (#1INJ)
TOUTS
TOUTF
C1
t1
t2t3
t4
t5
t6 t7
t8

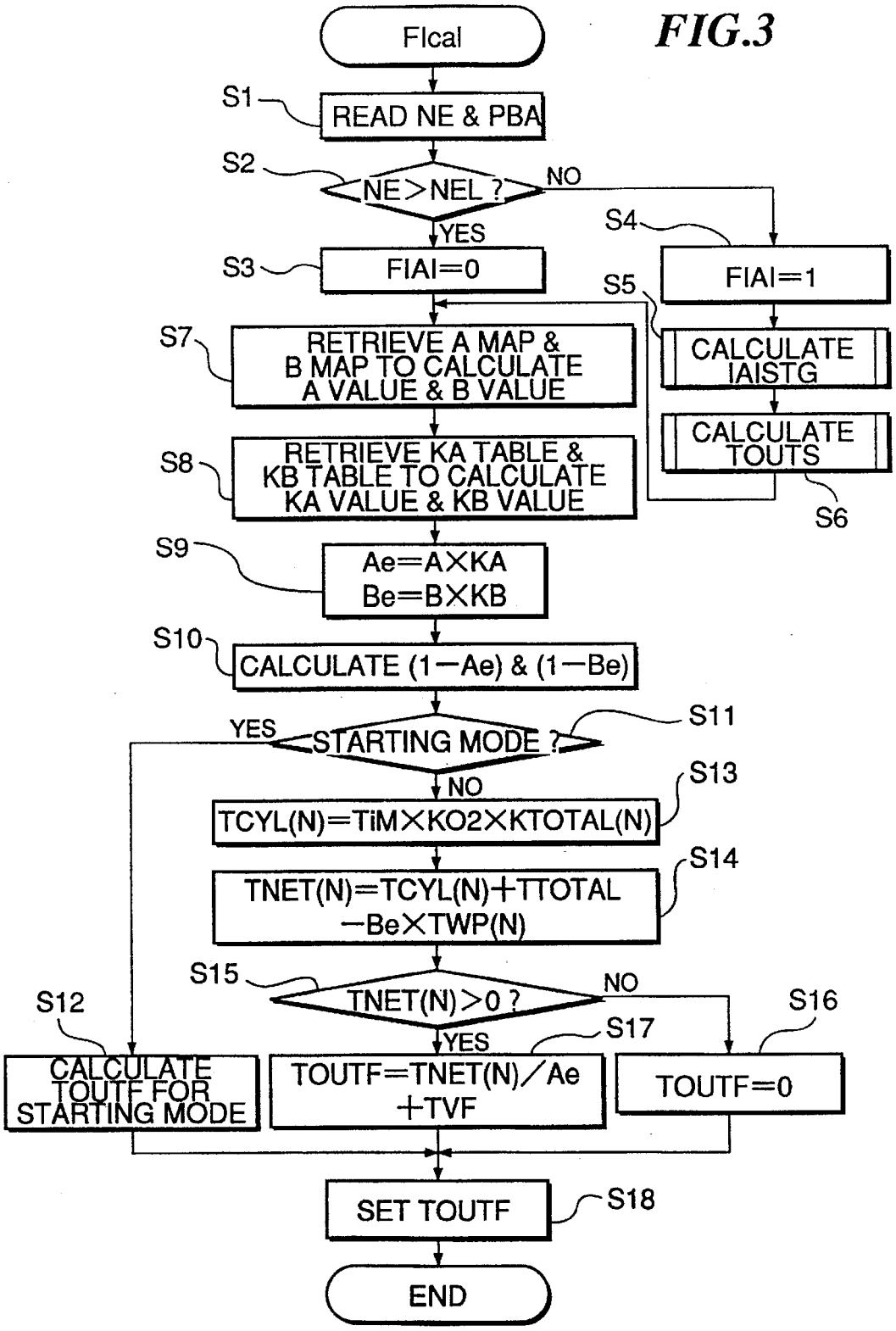
FIcal
FIG.3
S1
READ NE & PBA
S2
NE>NEL ?
NO
YES
S3
FIAI=0
S4
FIAI=1
S5
CALCULATE IAISTG
CALCULATE TOUTS
S6
S7
RETRIEVE A MAP & B MAP TO CALCULATE A VALUE & B VALUE
S8
RETRIEVE KA TABLE & KB TABLE TO CALCULATE KA VALUE & KB VALUE
S9
Ae=A×KA
Be=B×KB
S10
CALCULATE (1−Ae) & (1−Be)
S11
STARTING MODE ?
YES
NO
S13
TCYL(N)=TiM×KO2×KTOTAL(N)
S14
TNET(N)=TCYL(N)+TTOTAL −Be×TWP(N)
S15
TNET(N)>0 ?
NO
YES
S12
CALCULATE TOUTF FOR STARTING MODE
S17
TOUTF=TNET(N)/Ae +TVF
S16
TOUTF=0
SET TOUTF
S18
END

*FIG.4*

| | NE0 | NE1 | NE2 | NE3 |
|---|---|---|---|---|
| PBA0 | IAISTG (0,0) | ..... | ..... | IAISTG (0,3) |
| PBA1 | ⋮ | | | |
| PBA2 | ⋮ | | | |
| PBA3 | IAISTG (3,0) | | | IAISTG (3,3) |

*FIG.5*

| | TW0 | ⋯ | TW6 |
|---|---|---|---|
| PBA0 | A(0,0) | ⋯ | A(0,6) |
| ⋮ | ⋮ | ⋱ | ⋮ |
| PBA6 | A(6,0) | ⋯ | A(6,6) |

*FIG.6*

| | TW0 | ⋯ | TW6 |
|---|---|---|---|
| PBA0 | B(0,0) | ⋯ | B(0,6) |
| ⋮ | ⋮ | ⋱ | ⋮ |
| PBA6 | B(6,0) | ⋯ | B(6,6) |

FUEL INJECTION CONTROL SYSTEM FOR INTERNAL COMBUSTION ENGINES

BACKGROUND OF THE INVENTION

1. Field of the Invention

This invention relates to a fuel injection control system for internal combustion engines, and more particularly to a fuel injection control system of this kind, which controls a fuel injection amount so as to compensate for an amount of fuel adhering to the intake system of the engine.

2. Prior Art

An internal combustion engine of the type that fuel is injected into the intake pipe of the engine has the disadvantage that part of the injected fuel adheres to a wall surface of the intake pipe and hence a desired amount of fuel is not supplied into the combustion chamber of the engine. As one of solutions to overcome the disadvantage, a fuel injection amount control method is conventionally known, for example, from Japanese Patent Publication (Kokoku) No. 3-59255, which calculates a ratio of a fuel amount adhering to the wall surface of the intake pipe (adherent fuel amount ratio) and a ratio of a fuel amount carried off the wall surface of the intake pipe (carried-off fuel amount ratio), according to operating conditions of the engine, and corrects the fuel injection amount by adding an adherent fuel amount calculated from the adherent fuel amount ratio and subtracting a carried-off fuel amount calculated from the carried-off fuel amount ratio to and from the fuel injection amount, respectively, to thereby determine an amount of fuel to be supplied.

In the known fuel injection amount control method, the adherent fuel amount, which is used to calculate the carried-off fuel amount, is calculated based on a fuel amount to be supplied in the present fuel injection. However, in the case of split injection where fuel is injected a plurality of number of times in one cycle of the engine, the adherent fuel amount is calculated only for a fuel amount to be supplied in the first fuel injection but not taken into consideration for fuel amounts supplied in the second injection et seq. As a result, according to the above fuel injection amount control method, when the split injection is carried out, the accuracy of calculation of the adherent fuel amount is degraded.

To carry out adherent fuel amount-based correction even for the split injection, a fuel injection control system has been proposed, for example, by Japanese Provisional Patent Publication (Kokai) No. 3-23339, which calculates an adherent fuel amount for a fuel injection amount to be supplied in each injection of the split injection.

The above proposed fuel injection control system calculates an adherent fuel amount for each fuel injection, and calculates an amount of fuel to be supplied in each fuel injection, based on the thus calculated adherent fuel amount. Therefore, even when the split injection is carried out, the amount of fuel to be supplied in each fuel injection can be corrected by the adherent fuel amount, whereby a desired amount of fuel can be supplied into the combustion chamber of the engine.

However, the above proposed fuel control system calculates the adherent fuel amount for each fuel injection when the split injection is carried out. Therefore, this requires complicated arithmetic processing, which imposes a large burden on the software of the fuel control system.

More specifically, the above proposed fuel injection control system carries out the split injection when the fuel injection amount in the present cycle is larger than a predetermined value, such as during warming-up of the engine and during acceleration of the engine, and controls the fuel injection amount by calculating the adherent fuel amount for each fuel injection during the split injection. That is, in the proposed fuel injection control system, an additional injection is carried out in addition to a main injection to increase the fuel injection amount in the present cycle, during the split injection such as during acceleration of the engine. On this occasion, a calculation of an adherent fuel amount based on a fuel injection period for the main injection and a calculation of an adherent fuel amount based on a fuel injection period for the additional injection are carried out. This requires an increased amount of arithmetic processing as well as complicated arithmetic processing.

SUMMARY OF THE INVENTION

It is an object of the invention to provide a fuel injection control system for internal combustion engines, which is capable of properly controlling the fuel injection amount by calculating an amount of fuel adhering to the intake system of the engine in a simple and accurate manner.

To attain the above object, the present invention provide a fuel injection control system for an internal combustion engine having an intake system, at least one combustion chamber, and at least one fuel injection valve disposed to inject fuel into the intake system, comprising:

operating condition-detecting means for detecting operating conditions of the engine;

direct supply ratio-calculating means for calculating a direct supply ratio defined as a ratio of a fuel amount directly drawn into the at least one combustion chamber to a whole fuel amount injected by the at least one fuel injection valve, based on the operating conditions of the engine detected by the operating condition-detecting means;

carry-off ratio-calculating means for calculating a carry-off ratio defined as a ratio of a fuel amount carried off the intake system of the engine and drawn to the at least one combustion chamber to a whole fuel amount which adhered to the intake system, based on the detected operating conditions of the engine;

fuel amount-increasing operating condition-detecting means for detecting a predetermined operating condition of the engine in which an increased amount of fuel is to be supplied to the engine, based on the detected operating conditions of the engine;

fuel injection amount-calculating means responsive to detection of the predetermined operating condition of the engine by the fuel amount-increasing operating condition-detecting means, for calculating a plurality of fuel injection amounts to be sequentially injected by the at least one fuel injection valve, based on the detected operating conditions of the engine, the direct supply ratio calculated by the direct supply ratio-calculating means and the carry-off ratio calculated by the carry-off ratio-calculating means;

adherent fuel amount-calculating means for calculating an amount of fuel adhering to the intake system of the engine, based on a total sum of the plurality of fuel injection amounts calculated by the fuel injection amount-calculating means, as well as on the calculated direct supply ratio and the calculated carry-off ratio;

correction means for correcting at least one of the calculated plurality of the fuel injection amounts, based on the amount of fuel adhering to the intake system calculated by the adherent fuel amount-calculating means; and control means for controlling the at least one fuel injection valve to sequentially carry out a plurality of fuel injections in one operating cycle of the engine, based on the calculated plurality of fuel injection amounts including the at least one thereof corrected by the correction means.

Preferably, the predetermined fuel amount-increasing operating condition of the engine includes a predetermined accelerating condition of the engine.

Also preferably, the engine operating condition-detecting means includes at least engine speed-detecting means for detecting rotational speed of the engine, load condition-detecting means for detecting load on the engine, and engine coolant temperature-detecting means for detecting coolant temperature of the engine, the direct supply ratio-calculating means and the carry-off ratio-calculating means calculating, respectively, the direct supply ratio and the carry-off ratio, based on the rotational speed of the engine detected by the engine speed-detecting means, the load on the engine detected by the load condition-detecting means and the coolant temperature of the engine detected by the engine coolant temperature-detecting means.

In a preferred embodiment of the invention, there is provided a fuel injection control system for an internal combustion engine having an intake system, at least one combustion chamber, and at least one fuel injection valve disposed to inject fuel into the intake system, comprising:

operating condition-detecting means for detecting operating conditions of the engine;

direct supply ratio-calculating means for calculating a direct supply ratio defined as a ratio of a fuel amount directly drawn into the at least one combustion chamber to a whole fuel amount injected by the at least one fuel injection valve, based on the operating conditions of the engine detected by the operating condition-detecting means;

carry-off ratio-calculating means for calculating a carry-off ratio defined as a ratio of a fuel amount carried off the intake system of the engine and drawn to the at least one combustion chamber to a whole fuel amount which adhered to the intake system, based on the detected operating conditions of the engine;

main fuel injection amount-calculating means for calculating a main fuel injection amount to be injected by the at least one fuel injection valve, based on the direct supply ratio calculated by the direct supply ratio-calculating means and the carry-off ratio calculated by the carry-off ratio-calculating means;

fuel amount-increasing operating condition-detecting means for detecting a predetermined operating condition of the engine in which an increased amount of fuel is to be supplied to the engine, based on the detected operating conditions of the engine;

additional fuel injection amount-calculating means responsive to detection of the predetermined operating condition of the engine by the fuel amount-increasing operating condition-detecting means, for calculating an additional fuel injection amount to be injected by the at least one fuel injection valve, based on the detected operating conditions of the engine, and the calculated direct supply ratio;

adherent fuel amount-calculating means for calculating an amount of fuel adhering to the intake system of the engine, based on a total sum of the main fuel injection amount calculated by the main fuel injection amount-calculating means and the additional fuel injection amount calculated by the additional fuel injection amount-calculating means, as well as on the calculated direct supply ratio and the calculated carry-off ratio;

correction means for correcting at least the calculated plurality of the fuel injection amounts, based on the amount of fuel adhering to the intake system calculated by the adherent fuel amount-calculating means; and control means for controlling the at least one fuel injection valve to sequentially carry out a main fuel injection and an additional fuel injection in one operating cycle of the engine, respectively, based on the main fuel injection amount corrected by the correction means and the calculated additional fuel injection amount.

The above and other objects, features and advantages of the invention will become more apparent from the following detailed description taken in conjunction with the accompanying drawings.

BRIEF DESCRIPTION OF THE DRAWINGS

FIG. 3 is a flowchart showing a program for calculating a main fuel injection amount TOUTF;

FIG. 4 shows an IAISTG map used for calculating an additional injection execution stage IAISTG;

FIG. 5 shows an A map used for calculating a basic direct supply ratio A;

FIG. 6 shows a B map used for calculating a basic carry-off ratio B;

DETAILED DESCRIPTION

The invention will now be described in detail with reference to the drawings showing an embodiment thereof.

Figure 1:
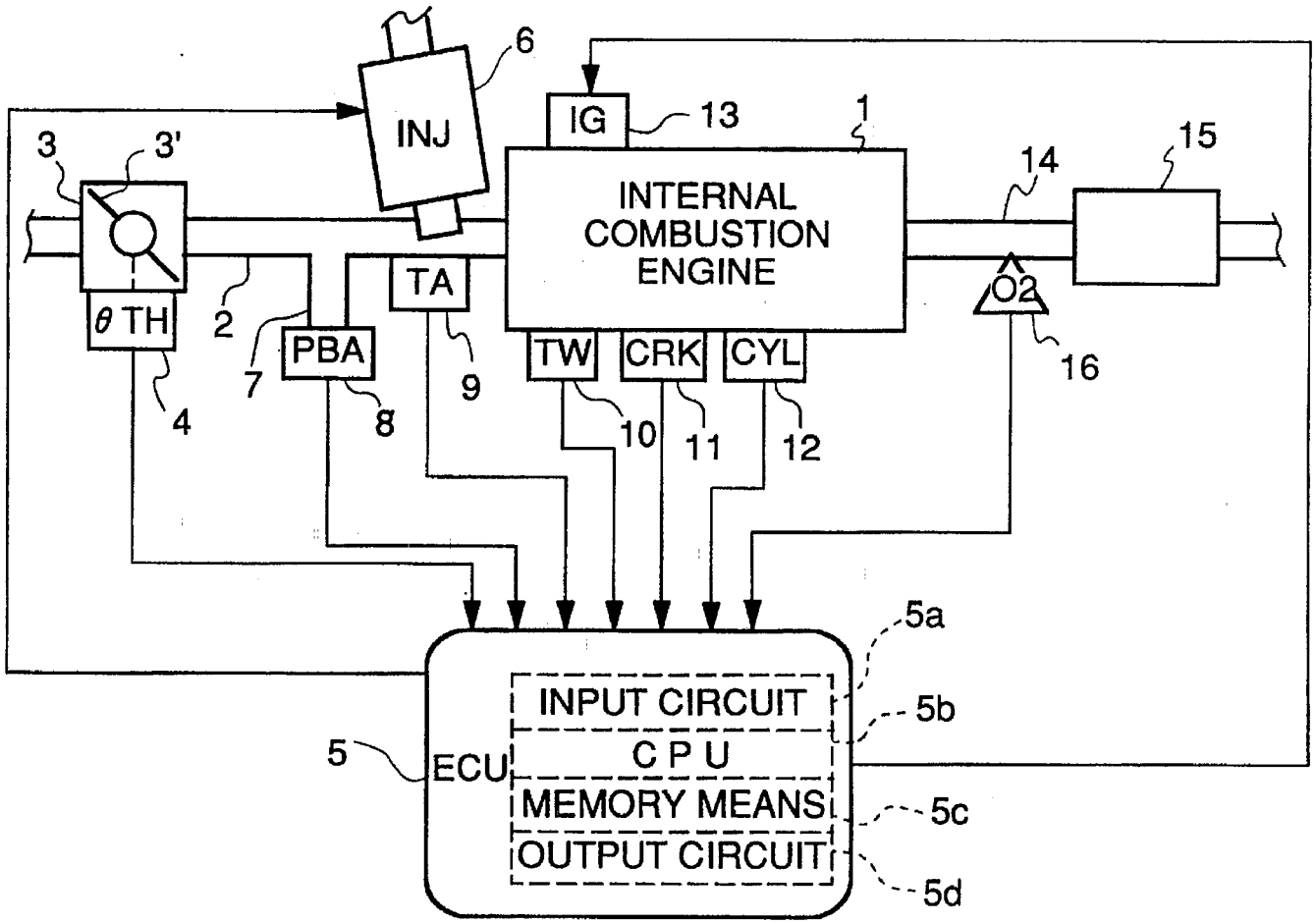
FIG. 1 is a block diagram schematically showing the whole arrangement of an internal combustion engine and a fuel injection control system therefor, according to an embodiment of the invention.

Referring first to FIG. 1, there is schematically illustrated the whole arrangement of an internal combustion engine and a fuel injection control system therefor, according to an embodiment of the invention.

In the figure, reference numeral 1 designates a DOHC straight type four-cylinder engine (hereinafter simply referred to as "the engine") having each cylinder thereof provided with a pair of intake valves, not shown, and a pair of exhaust valves, not shown. Connected to an intake port, not shown, of the cylinder block of the engine 1 is an intake pipe 2 across which is arranged a throttle body 3 accommodating a throttle valve 3' therein. A throttle valve opening (θTH) sensor 4 is connected to the throttle valve 3' for generating an electric signal indicative of the sensed throttle valve opening θTH and supplying same to an electronic control unit (hereinafter referred to as "the ECU") 5.

Fuel injection valves 6, only one of which is shown, are inserted into the intake pipe 2 at locations intermediate between the cylinder block of the engine 1 and the throttle valve 3' and slightly upstream of respective intake valves, not shown. The fuel injection valves 6 are connected to a fuel pump, not shown, and electrically connected to the ECU 5 to have their valve opening periods controlled by signals therefrom.

Further, an intake pipe absolute pressure (PBA) sensor 8 is provided in communication with the interior of the intake pipe 2 via a conduit 7 opening into the intake pipe 2 at a location downstream of the throttle valve 3'. The PBA sensor 8 is electrically connected to the ECU 5, for supplying an electric signal indicative of the sensed absolute pressure PBA within the intake pipe 2 to the ECU 5.

An intake air temperature (TA) sensor 9 is inserted into an inner wall surface of the intake pipe 2 at a location downstream of the conduit 7, for supplying an electric signal indicative of the sensed intake air temperature TA to the ECU 5.

An engine coolant temperature (TW) sensor 10 formed of a thermistor or the like is inserted into a coolant passage filled with a coolant and formed in the cylinder block, for supplying an electric signal indicative of the sensed engine coolant temperature TW to the ECU 5.

A crank angle (CRK) sensor 11 and a cylinder-discriminating (CYL) sensor 12 are arranged in facing relation to a camshaft or a crankshaft of the engine 1, neither of which is shown.

The CRK sensor 11 generates a CRK signal pulse whenever the crankshaft rotates through a predetermined angle (e.g. 45 degrees) smaller than half a rotation (180 degrees) of the crankshaft of the engine 1, while the CYL sensor 12 generates a pulse (hereinafter referred to as "the CYL signal pulse") at a predetermined crank angle of a particular cylinder of the engine, both of the CRK signal pulse and the CYL signal pulse being supplied to the ECU 5.

Each cylinder of the engine 1 has a spark plug 13 electrically connected to the ECU 5 to have its ignition timing controlled by a signal therefrom.

A catalytic converter (three-way catalyst) 15 is arranged in an exhaust pipe 14 connected to an exhaust port, not shown, of the engine 1, for purifying noxious components, such as HC, CO, NOx, which are present in exhaust gases from the engine.

An oxygen concentration sensor (hereinafter referred to as "the 02 sensor") 16 is arranged in the exhaust pipe 14 at a location upstream of the catalytic converter 15. The O2 sensor 16 detects the concentration of oxygen present in exhaust gases, and supplies an electric signal indicative of the sensed O2 concentration to the ECU 5.

The ECU 5 is comprised of an input circuit **5*a* having the functions of shaping the waveforms of input signals from various sensors as mentioned above, shifting the voltage levels of sensor output signals to a predetermined level, converting analog signals from analog-output sensors to digital signals, and so forth, a central processing unit (hereinafter referred to as the "the CPU") 5*b*, memory means 5*c* formed of a ROM (read only memory) storing various operational programs which are executed by the CPU 5*b*, and various maps and tables, referred to hereinafter, and a RAM (random access memory) for storing results of calculations therefrom, etc., an output circuit 5*d* which outputs driving signals to the fuel injection valves 6, the spark plugs 13**, etc.

Figures 2A, 2B, 2C, 2D:
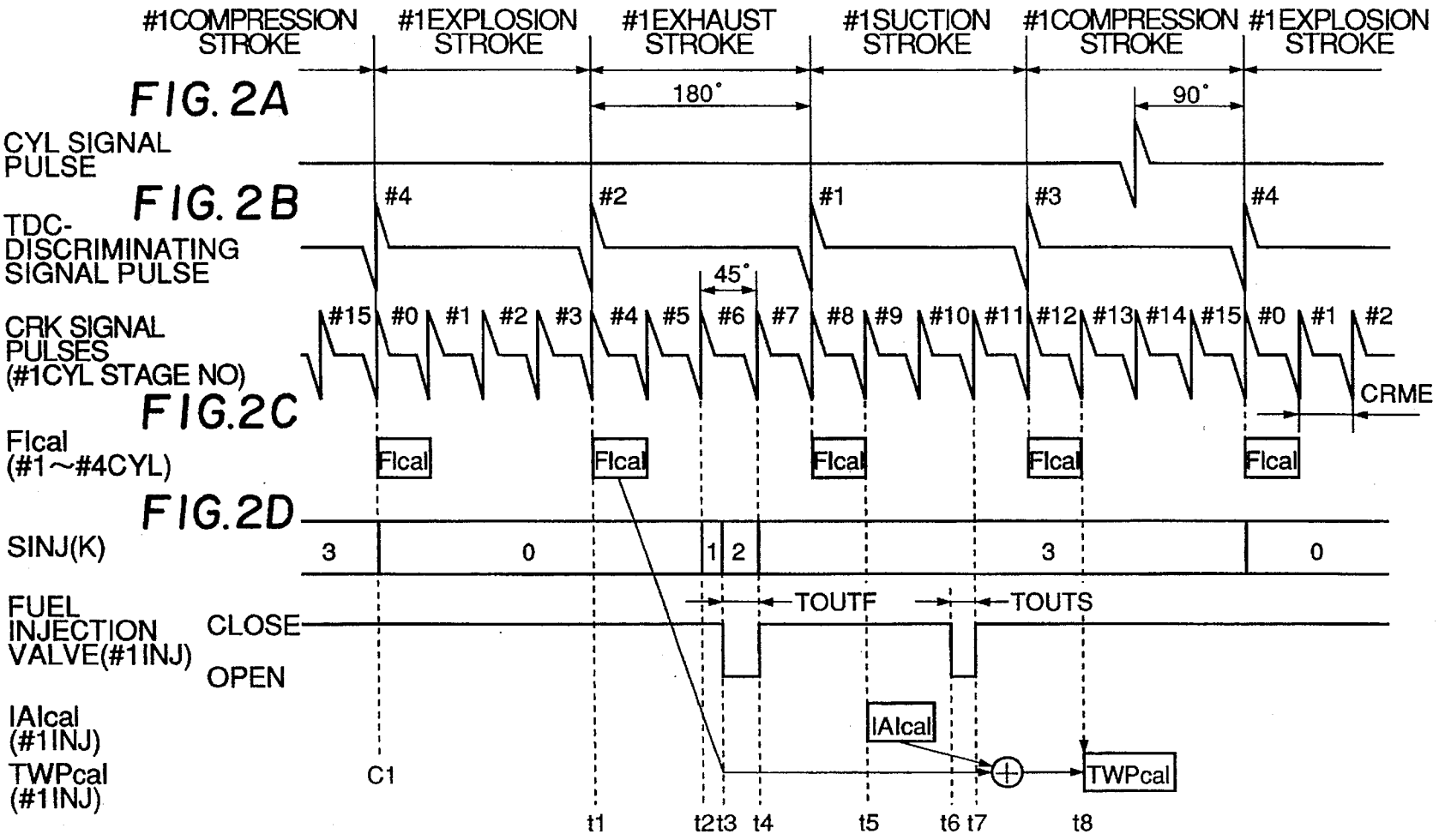
FIG. 2 is a timing chart showing a CYL signal pulse, TDC-discriminating signal pulses, CRK signal pulses, a status number SINJ(K), the operative state of a fuel injection valve of a #1 cylinder, etc.

FIG. 2 shows a timing chart showing the relationship in timing between CRK signal pulses from the CRK sensor 11, a CYL signal pulse from the CYL sensor 12, TDC-discriminating signal pulses from the ECU 5, and injection timing of fuel by the fuel injection valve 6 of the #1 cylinder.

Sixteen CRK signal pulses are generated per two rotations of the crankshaft at regular intervals with respect to the top dead center position of each of the four cylinders (#1 to #4 CYL), i.e. one CRK signal pulse whenever the crankshaft rotates through 45 degrees. The ECU 5 generates a TDC-discriminating signal in synchronism with a CRK signal pulse generated at the top dead center position of each cylinder. That is, the TDC-discriminating signal pulses indicate reference crank angle positions of the respective cylinders and are each generated whenever the crankshaft rotates through 180 degrees. Further, the ECU 5 measures time intervals of generation of the CRK signal pulses to calculate CRME values, which are added together over a time period of generation of two TDC-discriminating signal pulses i.e. over a time period of one rotation of the crankshaft to calculate an ME value, and then calculates the engine rotational speed NE, which is the reciprocal of the ME value, based on the ME value.

CYL signal pulses are each generated as briefly described above, at a predetermined crank angle position of a particular cylinder (#1 cylinder in the illustrated example), e.g. when the #1 cylinder is in a position 90 degrees before a TDC position thereof corresponding to the end of the compression stroke of the cylinder, to thereby allot a particular cylinder number (e.g. #1 CYL) to a TDC-discriminating signal pulse generated immediately after a CYL signal pulse is generated.

The ECU 5 detects crank angle stages (hereinafter referred to as "the stages") in relation to the reference crank angle position of each cylinder, based on the CRK signal pulses. More specifically, the ECU 5 determines, for instance, that the #1 cylinder is in a #0 stage when a CRK signal pulse C1 is generated, which corresponds to a TDC-discriminating signal pulse generated at the end of the compression stroke of the #1 cylinder. The ECU 5 sequentially determines thereafter that the #1 cylinder is in a #1 stage, in a #2 stage, . . . and in a #15 stage, based on CRK signal pulses generated thereafter.

Further, an injection stage of a cylinder at which injection should be started is set depending on operating conditions of the engine 1, more particularly by executing an injection stage-determining routine, not shown. Further, a main fuel injection period (main fuel injection amount) TOUTF over which the fuel injection valve 6 is open is controlled by the use of a status number (SINJ(K)) determined in relation to the injection stage. More specifically, according to the fuel injection control system, when a split injection is carried out, a total fuel injection period TOUT over which fuel is injected by the fuel injection valve 6 in one cycle of the engine consists of the main fuel injection period TOUTF injected before the start of the suction stroke, which is calculated according to operating conditions of the engine 1 and dynamic characteristics of fuel, and an additional fuel injection period TOUTS injected during the suction stroke, according to an accelerating condition of the engine 1, wherein the main fuel injection period TOUTF is controlled based on the set state of the status number SINJ(K).

Specifically, if the ECU 5 detects a predetermined injection stage (e.g. #6 stage) before the start of the suction stroke, it sets the status number SINJ(K) to "1" After a predetermined injection delay time period has elapsed, the status number SINJ(K) is set to "2", at which fuel starts to be injected by the fuel injection valve 6 over the main fuel injection period TOUTF. After the main fuel injection period TOUTF has elapsed to close the fuel injection valve 6, the status number SINJ(K) is set to "3". More specifically, generation of a TDC-discriminating signal triggers start of an FIcal routine (TOUTF-calculating routine) at a time point t1 to calculate a main fuel injection stage FISTG and the main fuel injection period TOUTF. Then, at a time point t2 an injection delay timer (stored in the ECU 5) is started to count an injection delay time period, and at a time point t3 the fuel injection valve 6 is opened. When the main fuel injection period TOUTF elapses at a time point t4, the fuel injection valve 6 is closed. Then, upon termination of the fuel injection, the status number SINJ(K) is set to "3", and then reset to "0" simultaneously with the start of the explosion stroke.

In the FIcal routine, an additional injection-executing stage IAISTG (hereinafter referred to as "the additional fuel injection stage") which is to be executed in the suction stroke can be calculated. During execution of the IAIcal routine (TOUTS-calculating routine), when the additional fuel injection stage IAISTG is detected and at the same time an accelerating condition of the engine 1 is detected, an additional injection is carried out. In the illustrated example, upon generation of a CRK signal pulse at a time point t5, the IAIcal routine is triggered. During execution of the IAIcal routine, when the additional fuel injection stage IAISTG is detected and at the same time the engine 1 is detected to be in an accelerating condition, the additional fuel injection period TOUTS is calculated, over which an additional injection is carried out, for example, for the #1 cylinder in the suction stroke. That is, the fuel injection valve 6 starts to be opened, for example, at a time point t6 and is closed at a time point t7 corresponding to the time the additional fuel injection period TOUTS has elapsed.

In the present embodiment, when SINJ(K)=3 holds, i.e. before the start of the explosion stroke, a TWPcal routine is executed in synchronism with generation of a CRK signal pulse to calculate an adherent fuel amount TWP adhering to the intake pipe 2, and then the main fuel injection period TOUTF for the next cycle is calculated based on the adherent fuel amount TWP thus calculated. In the illustrated example, upon generation of a CRK signal pulse at a time point t8, the TWPcal routine is triggered, whereby the adherent fuel amount TWP is calculated based on the total fuel injection period TOUT obtained by adding together the main fuel injection period TOUTF and the additional fuel injection period TOUTS. The adherent fuel amount TWP thus calculated is reflected on the TOUTF value which is calculated in the next cycle.

The reason why the injection delay time period (time period corresponding to the status number SINJ(K)=1) is provided before the start of fuel injection is that the injection timing is controlled such that the fuel injection termination is made synchronous with generation of a CRK signal pulse, i.e. the termination of the injection timing is controlled by the use of the injection delay time period. Similarly, the injection timing for the additional fuel injection period TOUTS is controlled such that the fuel injection termination is made synchronous with generation of a CRK signal pulse, by the use of a delay time period for additional injection, not shown.

Control procedures of the above fuel injection will be described with reference to flowcharts.

FIG. 3 shows details of the FIcal routine for calculating the main fuel injection period TOUTF over which fuel is injected by the fuel injection valve 6. This routine is executed for each cylinder in synchronism with generation of each TDC-discriminating signal pulse, as described above.

At a step S1, the engine rotational speed NE (calculated based on output values from the CRK sensor 11) and the intake pipe absolute pressure PBA (detected by the PBA sensor 9, and hereinafter referred to as "the TDC-corresponding intake pipe absolute pressure") are read. Then, it is determined at a step S2 whether or not the engine rotational speed NE is higher than a predetermined value NEL. The predetermined engine speed value NEL is set at a value at or below which the additional injection is required. Specifically, it is generally recognized that the additional injection is required when the engine operating condition is changed from a steady state to an accelerating state, which means that the additional injection is not required when the engine is operating at a high rotational speed. Based on the above recognition, the predetermined engine speed value NEL is set, for example, at 2000 rpm. If the answer is affirmative (YES), i.e. if it is determined that the engine rotational speed NE is higher than the predetermined value NEL and hence the additional injection is not required, a flag FIAI is set to "0" to inhibit the additional injection, followed by the program proceeding to a step S7. On the other hand, if the answer at the step S2 is negative (NO), i.e. if it is determined that the engine rotational speed NE is lower than the predetermined value NEL and hence the additional injection is required, the flag FIAI is set to "1" to permit the additional injection, at a step S4, and then an IAISTG map is retrieved to calculate the additional fuel injection stage IAISTG, at a step S5.

The IAISTG map is set, e.g. as shown in FIG. 4, such that map values IAISTG (0,0) to IAISTG (3,3) are provided in a manner corresponding to predetermined values NE0 to NE3 (≦NEL) of the engine rotational speed and predetermined values PBA0 to PBA3 of the intake pipe absolute pressure, for selecting the stages #8 to #11 in the suction stroke. Thus, the additional fuel injection stage IAISTG is calculated by retrieving the IAISTG map, to thereby determine the additional fuel injection stage IAISTG during which the additional injection is to be carried out in the suction stroke.

Then, the program proceeds to a step S6, wherein the IAIcal routine, which is an interrupt routine triggered by a CRK signal pulse, is executed to calculate the additional fuel injection period TOUTS, followed by the program proceeding to the step S7.

At the step S7 and steps S8 and S9, a direct supply ratio Ae and a carry-off ratio Be are calculated. The direct supply ratio Ae is defined as a ratio of a fuel amount directly or immediately drawn into the combustion chamber to the whole fuel amount injected by the fuel injection valve 6 in a cycle, and the carry-off ratio Be is defined as a ratio of a fuel amount carried off the inner surface of the intake pipe 2 and drawn into the combustion chamber in the present cycle to the whole fuel amount which adhered to the inner surface of the intake pipe 2 in the last cycle.

At the step S7, the basic direct ratio A and the basic carry-off ratio B are calculated by retrieving an A map and a B map.

The A map is set, e.g. as shown in FIG. 5, such that map values A(0,0) to A(6,6) are provided in a manner corresponding to predetermined values PBA0 to PBA6 of the intake pipe absolute pressure PBA and predetermined values TWO to TW6 of the engine coolant temperature TW. The basic direct supply ratio A is determined by being read from the A map, and additionally by interpolation, if required.

The B map is set similarly to the A map, e.g. as shown in FIG. 6, such that map values B(0,0) to B(6,6) are provided in a manner corresponding to the predetermined values PBA0 to PBA6 of the intake pipe absolute pressure PBA and the predetermined values TWO to TW6 of the engine coolant temperature TW. The basic carry-off ratio B is determined by being read from the B map, and additionally by interpolation, if required.

Then, at a step S8, an engine speed-dependent correction coefficient KA for the direct supply ratio Ae and an engine speed-dependent correction coefficient KB for the carry-off ratio Be are determined by retrieving a KA table and a KB table, respectively.

Figure 7:
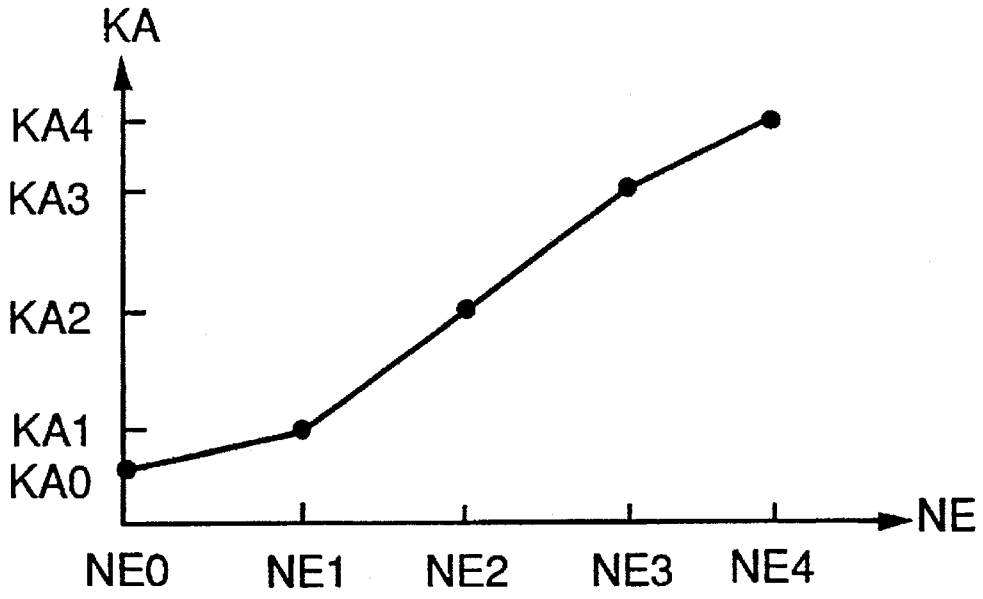
FIG. 7 shows a KA table used for calculating an engine speed-dependent correcting coefficient KA for a final direct supply ratio Ae.

The KA table is set, e.g. as shown in FIG. 7, such that table values KA0 to KA4 are provided in a manner corresponding to predetermined values NE0 to NE4 of the engine rotational speed NE. The engine speed-dependent correction coefficient KA is determined by being read from the KA table, and additionally by interpolation, if required. As is apparent form FIG. 7, the engine speed-dependent correction coefficient KA for the direct supply ratio is set to a larger value as the engine rotational speed NE becomes higher.

Figure 8:
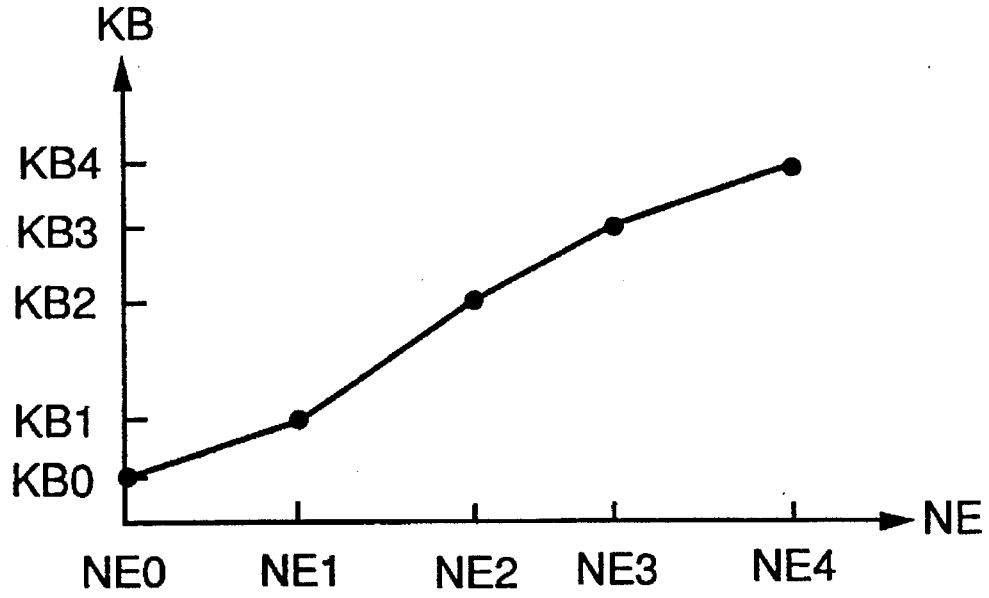
FIG. 8 shows a KB table used for calculating an engine speed-dependent correcting coefficient KB for a final carry-off ratio Be.

The KB table is set similarly to the KA table, e.g. as shown in FIG. 8, such that table values KB0 to KB4 are provided in a manner corresponding to the predetermined values NE0 to NE4 of the engine rotational speed NE. The engine speed-dependent correction coefficient KB is determined by being read from the KB table, and additionally by interpolation, if required. As is apparent from FIG. 8, similarly to the engine speed-dependent correction coefficient KA for the direct supply ratio, the engine speed-dependent correction coefficient KB is set to a larger value as the engine rotational speed NE becomes higher.

Then, at a step S9, the direct supply ratio Ae and the carry-off ratio Be are calculated by the use of the following equations (1) and (2), and at a step S10, values (1—Ae) and (1—Be) are calculated, followed by the program proceeding to a step S11:

$$Ae=A\times KA \tag{1}$$

$$Be=B\times KB \tag{2}$$

These values Ae, (1—Ae) and (1—Be) are to be used in programs of FIGS. 9 and 11, described hereinafter, and therefore they are stored into the RAM in the memory means 5*c*.

Then, it is determined at the step S11 whether or not the engine 1 is in starting mode, i.e. whether or not a starter switch, not shown, of the engine has been turned on and at the same time the engine rotational speed NE is lower than a predetermined value for the starting mode (cranking rotational speed). If it is determined that the engine is in the starting mode, the program proceeds to a step S12, wherein a main fuel injection period TOUTF for the starting mode is calculated by the use of the following equation (3):

$$TOUTF=TiCR\times K1+K2 \tag{3}$$

where TiCR represents a basic fuel injection period suitable for the starting mode, which is determined according to the engine rotational speed NE and the intake pipe absolute pressure PBA. A TiCR map, not shown, is used for determining the TiCR value.

K1 and K2 represent other correction coefficients and correction variables, respectively, which are set depending on operating conditions of the engine to such values as optimize operating characteristics of the engine, such as the fuel consumption and the accelerability.

On the other hand, if it is determined at the step S11 that the engine is not in the starting mode but in basic operating mode, a step S13 is executed.

More specifically, at the step S13 a required fuel injection period TCYL(N) over which fuel is to be injected by the fuel injection valve 6 is calculated by the use of the following equation (4):

$$TCYL(N)=TiM\times KO2\times KTOTAL(N) \tag{4}$$

where TiM represents a basic fuel injection period suitable for the basic operating mode, which is determined, similarly to the TiCR value, according to the engine rotational speed NE and the intake pipe absolute pressure PBA. K02 represents an air-fuel ratio correction coefficient calculated based on an output from the O2 sensor 16. Further, KTOTAL(N) represents a product of values of various correction coefficients (engine coolant-dependent correction coefficient KTA, after-starting correction coefficient KAST, desired air-fuel ratio correction coefficient KCMD, etc.) determined according to operating conditions of the engine.

Then, at a step S14, a desired fuel injection period TNET(N) is calculated by the use of the following equation (5):

$$TNET(N)=TCYL(N)+TTOTAL-Be\times TWP(N) \tag{5}$$

where TTOTAL represents the sum of all addend correction variables (e.g. atmospheric pressure-dependent correction variable TPA) which are determined based on engine operating parameter signals from various sensors. However, an ineffective time period TVF for the main injection before the fuel injection valve 6 opens is not included in the TTOTAL value. TWP(N) represents an estimated amount of fuel adhering to the inner wall surface of the intake pipe 2, which is calculated according to a routine described hereinafter with reference to FIG. 11, and therefore the term (Be×TWP (N)) represents a fuel amount carried off the adherent fuel into the combustion chamber. This carried-off amount from the adherent fuel need not be newly supplied by injection, and hence is subtracted from the required fuel amount TCYL(N) in the equation (5).

At a step S15, it is determined whether or not the desired fuel injection period TNET calculated as above is larger than "0". If TNET(N)≦0 holds, the main fuel injection period TOUTF is set to "0" to forcibly interrupt the fuel supply at a step S16, followed by terminating the program.

On the other hand, if TNET(N)>0, the program proceeds to a step S17, wherein the main fuel injection period TOUTF is calculated by the use of the following equation (6):

$$TOUTF(N)=TNET(N)/Ae+TVF \tag{6}$$

where TVF represents the aforementioned ineffective time period for the main fuel injection of the fuel injection valve 6.

Then, at a step S18, the main fuel injection period TOUTF is set to the value calculated at the step S12, S16 or S17, followed by terminating the present program.

According to the present FIcal routine, when the main fuel injection period TOUTF is calculated at the step S17, the fuel injection valve 6 is opened for the main fuel injection period TOUTF, whereby fuel is supplied into the combustion chamber in an amount corresponding to a value (TNET (N)×KO2+Be×TWP(N)).

As described above, the main fuel injection period TOUTF(1) is calculated for the #1 cylinder, and thereafter calculations are similarly made of the main fuel injection periods TOUTF(N) (N=2, 3, 4) for the #2 to the #4 cylinders sequentially, by carrying out the steps S13 et seq.

Figure 9:
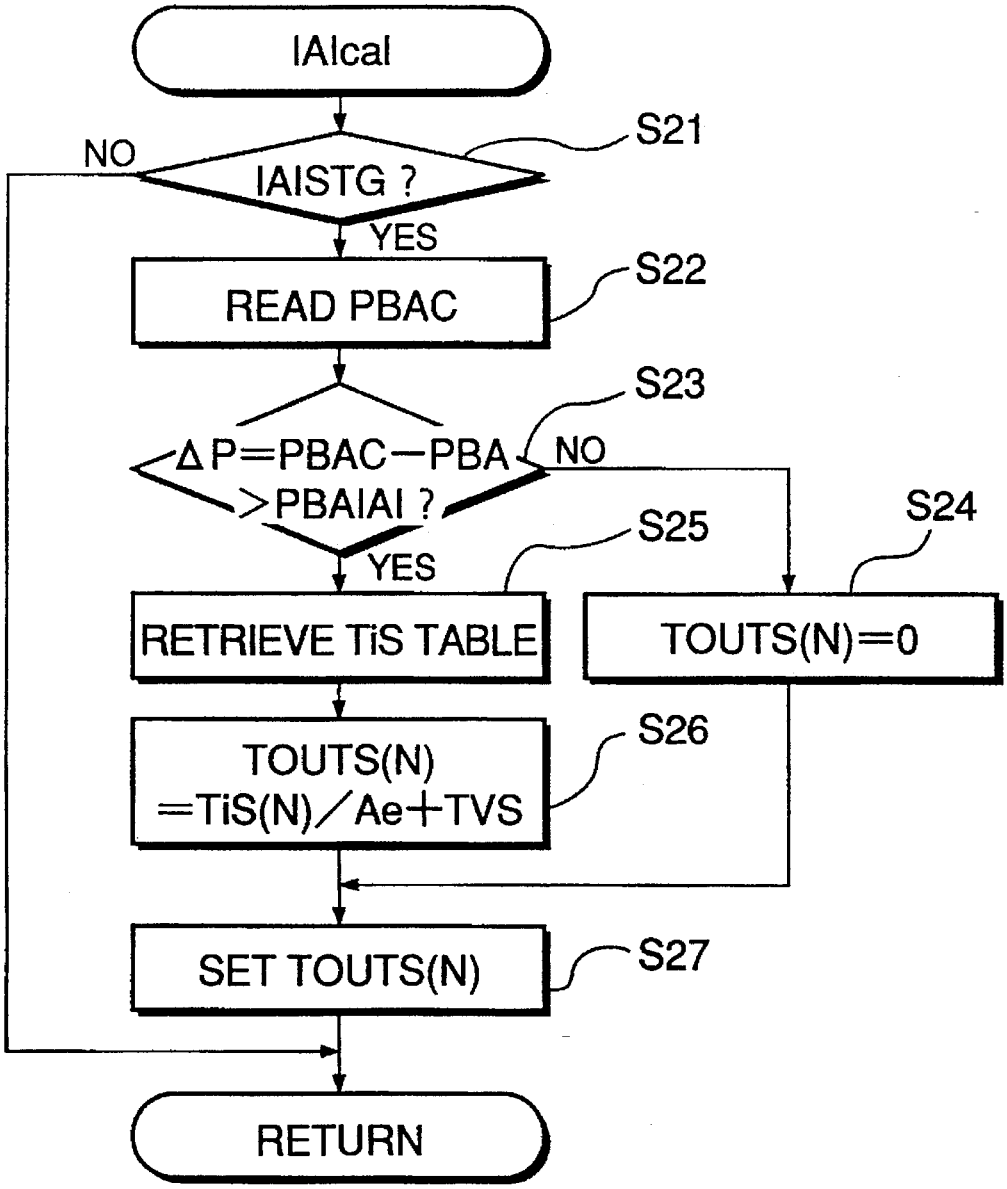
FIG. 9 is a flowchart showing a program for calculating an additional fuel injection amount TOUTS.

FIG. 9 shows details of the IAIcal routine for calculating the additional fuel injection period TOUTS. This routine is executed for each cylinder in synchronism with generation of a CRK signal pulse.

First, it is determined at a step S21 whether or not the additional fuel injection stage IAISTG has been detected. If the answer is negative (NO), the program is immediately terminated without calculating the additional fuel injection period TOUTS.

On the other hand, if the answer is affirmative (YES), a value PBAC of the intake pipe absolute pressure PBA obtained upon generation of the present CRK signal pulse (hereinafter referred to as "the CRK-corresponding intake pipe absolute pressure") is read in, at a step S22, and then it is determined at a step S23 whether or not a difference ΔP between the CRK-corresponding intake pipe absolute pressure PBAC and the TDC-corresponding intake pipe absolute pressure PBA is larger than a predetermined value PBAIAI. The PBAIAI value is set at a pressure variation (load variation) by which the engine can be determined to be in an accelerating condition, e.g. 500 mmHg. If the answer is negative (NO), it is determined that the engine 1 is not in the accelerating condition, and therefore the additional fuel injection period TOUTS(N) is set to "0", at steps S24 and S27, followed by terminating the present routine.

On the other hand, if the answer at the step S23 is affirmative (YES), it is determined that the engine is in the accelerating condition, and then the program proceeds to a step S25, wherein a basic additional fuel injection period TiS is calculated by retrieving a TiS table.

Figure 10:
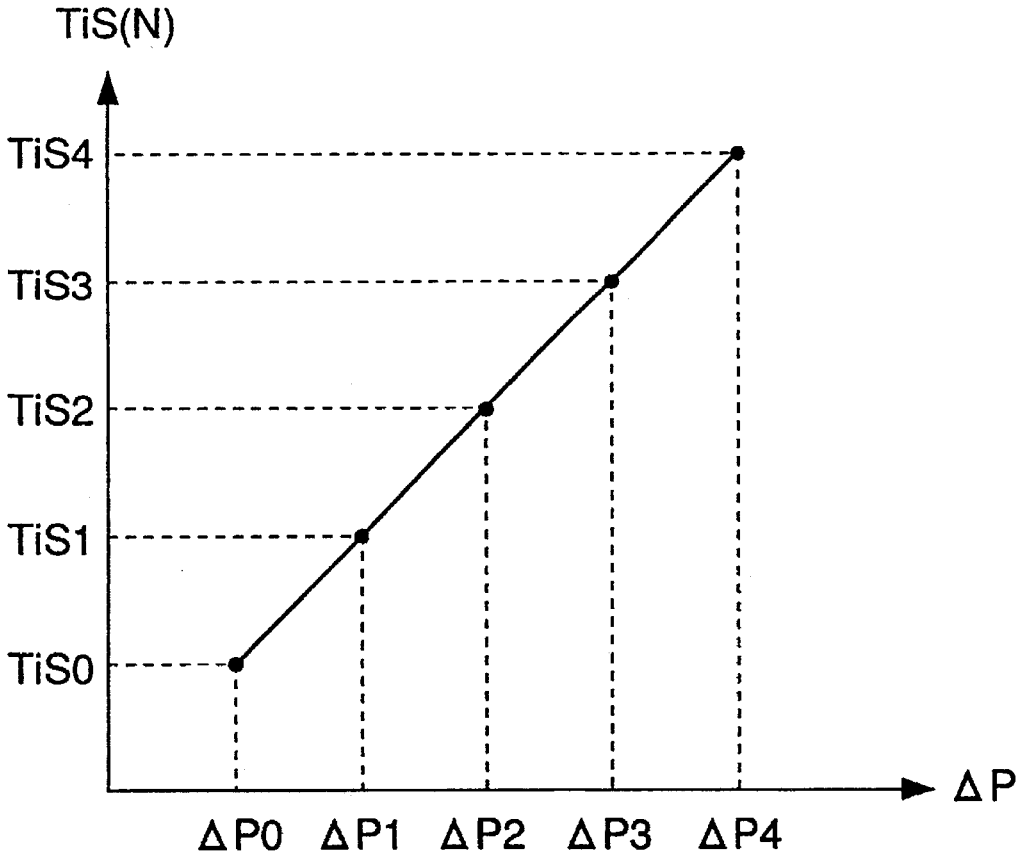
FIG. 10 shows a TiS table used for calculating a basic additional fuel injection amount TiS.

The TiS table is set, e.g. as shown in FIG. 10, such that table values TiS0 to TiS4 are provided in a manner corresponding to predetermined difference values ΔP to ΔP4 between the CRK-corresponding intake pipe absolute pressure PBAC and the TDC-corresponding intake pipe absolute pressure PBA. The basic additional fuel injection period TiS is determined by being read from the TiS table, and additionally by interpolation, if required.

Then, at a step S26, a value of the additional fuel injection period TOUTS is calculated by the use of the following equation (7), and the additional fuel injection period TOUTS is set to the thus calculated value at the step S27, followed by terminating the present routine:

$$TOUTS(N)=TiS(N)/Ae+TVS \quad (7)$$

where TVS represents an ineffective time period for the additional fuel injection of the fuel injection valve 6.

In this manner, first the additional fuel injection period TOUTS(i) is calculated for the #1 cylinder, and similarly, calculations are sequentially made of the additional fuel injection periods TOUTS(N) (N=2, 3, 4) for the #2 to #4 cylinders.

Figure 11:
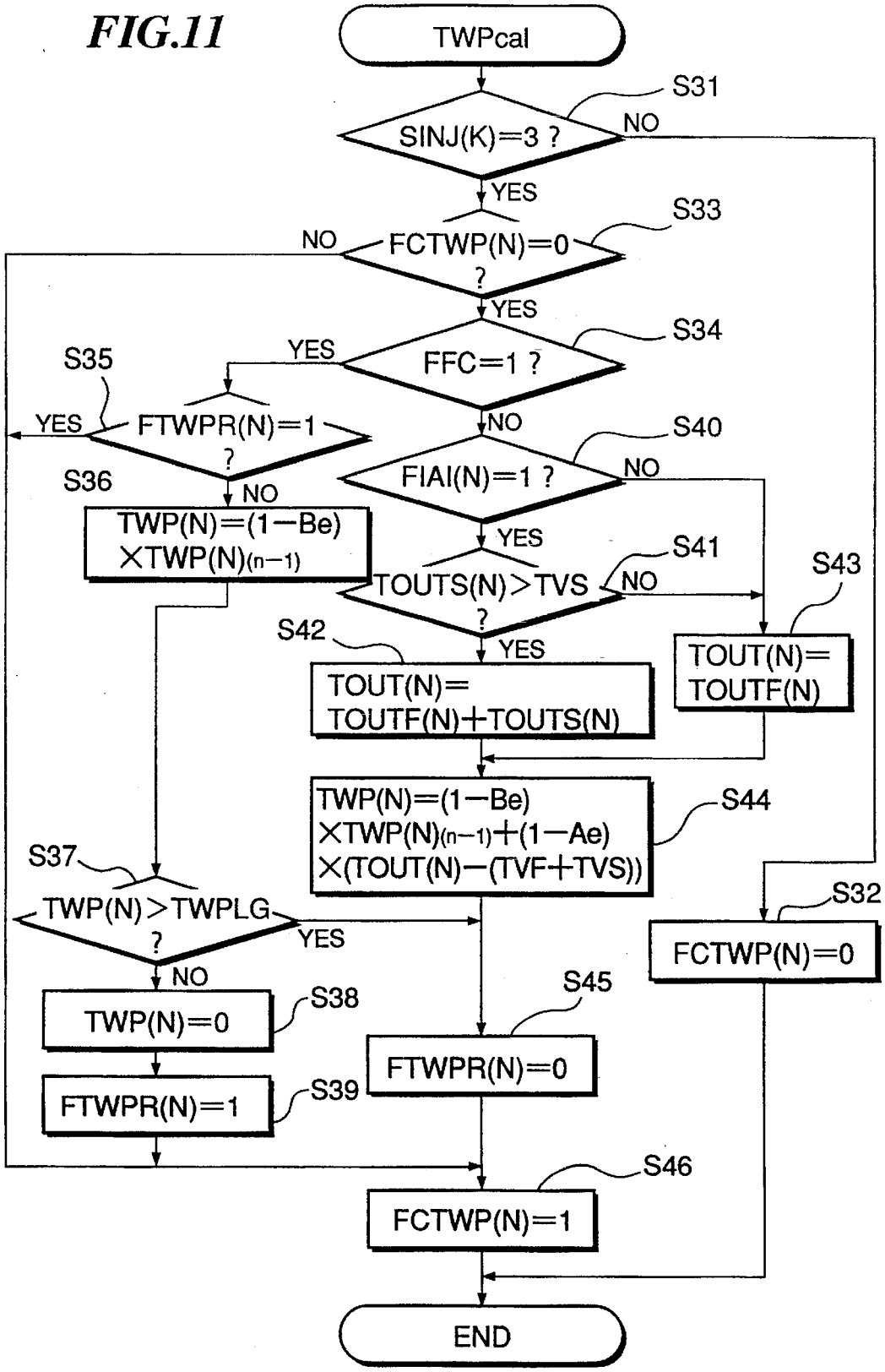
FIG. 11 is a flowchart showing a program for calculating an adherent fuel amount TWP.

FIG. 11 shows details of the TWPcal routine for calculating the adherent fuel amount TWP, which is executed in synchronism with generation of a CRK signal pulse, for each cylinder.

First, it is determined at a step S31 whether or not the status number SINJ(K) (see FIG. 2) is set to "3", which indicates termination of fuel injection.

If SINJ(K) is set to a number other than the program proceeds to a step S32, wherein a calculation-permitting flag FCTWP is set to "0" to allow the calculation of the adherent fuel amount TWP to be started in the next loop. On the other hand, if SINJ(K) is set to "3", it is determined at a step S33 whether or not the flag FCTWP(N) is set to "0". If FCTWP (N) is set to "1", the program proceeds to a step S46, followed by terminating the present routine. On the other hand, if the flag FCTWP(N) is set to "0", it is determined at a step S34 whether or not a flag FFC is set to "1", which means whether or not the fuel supply is being interrupted (the engine is under fuel cut). The determination as to whether or not the engine 1 is under fuel cut is carried out based on the engine rotational speed NE and the valve opening θTH of the throttle valve 3', specifically by executing a fuel cut-determining routine, not shown.

If it is determined at the step S34 that the engine is under fuel cut, then it is determined at a step S35 whether or not a flag FTWPR(N) is set to "1", i.e. whether or not the adherent fuel amount TWP(N) is negligible or zero. If the flag FTWPR(N) is set to "1", i.e. if the adherent fuel amount TWP(N) is negligible or zero, the program is terminated. On the other hand, if the flag FTWPR is set to "0", i.e. if the adherent fuel amount TWP is not negligible or zero, the program proceeds to a step S36, wherein the adherent fuel amount TWP(N) in the present loop is calculated by the use of the following equation (8):

$$TWP(N)=(1-Be)\times TWP(N)(n-1) \quad (8)$$

where TWP(N)(n−1) represents the adherent fuel amount obtained in the immediately preceding loop.

Then, it is determined at a step S37 whether or not the calculated adherent fuel amount TWP(N) is larger than a very small value TWPLG. If TWP(N)≦TWPLG holds, it is judged at a step S38 that the adherent fuel amount TWP is negligible or zero, i.e. TWP(n)=0, and further the flag FTWPR(N) is set to "1", at a step S39. Then, at the step S46 the flag FCTWP is set to "1" to indicate that the calculation of the adherent fuel amount TWP has been terminated, followed by terminating the program.

On the other hand, if it is determined at the step S34 that the engine is not under fuel cut, then it is determined at a step S40 whether or not the flag FIAI(N) is set to "1", i.e. whether or not the additional injection is permitted. If the answer is affirmative (YES), i.e. if the additional injection is permitted, the program proceeds to a step S41, wherein it is determined whether or not the additional fuel injection period TOUTS is larger than the ineffective time period TVS for additional fuel injection. If the answer is affirmative (YES), the additional injection actually has taken place, and therefore the total fuel injection period TOUT(N) is calculated by adding together the main fuel injection period TOUTF(N) and the additional fuel injection period TOUTS (N), by the use of the following equation (9), at a step S42:

$$TOUT\ (N)=TOUTF\ (N)+TOUTS(N) \quad (9)$$

On the other hand, if either the answer at the step S40 or S41 is negative (NO), i.e. if the additional injection is not permitted or the additional fuel injection period TOUTS is smaller than the ineffective time period TVS therefor, it is regarded that the additional injection has not been actually carried out, which means that the additional fuel injection period TOUTS is equal to "0". Therefore, the main fuel injection period TOUTF(N) is set to the total fuel injection period TOUT(N) in the present loop, at a step S43, followed by the program proceeding to a step S44.

Then, at the step S44, the adherent fuel amount TWP(N) is calculated by the use of the following equation (10):

$$TWP(N)=(1-Be)\times TWP(N)(n-1)+(1-Ae)\times (TOUT(N)-(TVF+TVS)) \quad (10)$$

where TWP(N)(n−1) represents an immediately preceding value of the adherent fuel amount TWP(N). The first term on the right side represents an amount of fuel which has not been carried off from the adherent fuel and remains on the inner wall surface of the intake pipe 2 in the present cycle, and the second term on the right side represents an amount of fuel which was injected in the present cycle and newly adhered to the inner wall surface of the intake pipe 2. The fuel amount newly adhering to the inner surface of the intake pipe 2 in the present loop is calculated by subtracting the ineffective period TVF for main fuel injection, and further the ineffective period TVS for additional fuel injection when the additional injection is carried out, from the total fuel injection period TOUT.

Then, at a step S45, the flag FTWPR is set to "0" to indicate that the adherent fuel amount TWP is present, and further the flag FCTWP is set to "1" to indicate that the calculation of the adherent fuel amount TWP has been terminated, at a step S46, followed by terminating the present routine.

In this manner, the adherent fuel amount TWP(1) is calculated for the #1 cylinder, and then similarly, calculations are sequentially made of the adherent fuel amounts TWP(N)(N=2, 3, 4), for the #2 to #4 cylinders.

According to the present embodiment, when the additional injection is carried out, the adherent fuel amount TWP adhering to the intake pipe 2 is calculated based on the total fuel injection period TOUT (main fuel injection period TOUTF+additional fuel injection period TOUTS), and then, based on the thus calculated adherent fuel amount TWP, the main fuel injection period TOUTF to be applied in the next cycle is calculated. Therefore, a desired amount of fuel can be drawn into the combustion chamber of the engine 1 even when the engine is accelerated. That is, the calculation of the adherent fuel amount TWP can be made in a simple and accurate manner, and the thus calculated adherent fuel amount TWP is reflected on the calculation of the main fuel injection period TOUTF to be applied in the next cycle, which enables an amount of fuel conforming to a required output of the engine to be supplied into the combustion chamber, to thereby prevent degraded exhaust emission characteristics of the engine even when the engine is accelerated.

According to the present invention, as described above, even when split injection is carried out to inject fuel a plurality of number of times in one cycle of the engine, a calculation of an adherent fuel amount is executed only once in one cycle of the engine, based on the total fuel injection amount injected by the split injection. Therefore, the calculation of the adherent fuel amount can be executed in a simple manner without increasing the burden on the software of the fuel control system.

In addition, even when the additional injection is carried out upon acceleration of the engine, the adherent fuel amount can be correctly calculated based on the additional fuel injection amount during the acceleration, and further the adherent fuel amount is reflected on the next calculation of the main fuel injection amount. Therefore, a desired amount of fuel conforming to operating conditions of the engine can be supplied into the combustion chamber. As a result, the accelerability of the engine commensurate with an output required of the engine can be attained, to thereby prevent degraded exhaust emission characteristics of the engine during acceleration of the engine.

What is claimed is:

1. A fuel injection control system for an internal combustion engine having an intake system, at least one combustion chamber, and at least one fuel injection valve disposed to inject fuel into said intake system, comprising:

operating condition-detecting means for detecting operating conditions of said engine;

direct supply ratio-calculating means for calculating a direct supply ratio defined as a ratio of a fuel amount directly drawn into said at least one combustion chamber to a whole fuel amount injected by said at least one fuel injection valve, based on the operating conditions of said engine detected by said operating condition-detecting means;

carry-off ratio-calculating means for calculating a carry-off ratio defined as a ratio of a fuel amount carried off said intake system of said engine and drawn to said at least one combustion chamber to a whole fuel amount which adhered to said intake system, based on the detected operating conditions of said engine;

fuel amount-increasing operating condition-detecting means for detecting a predetermined operating condition of said engine in which an increased amount of fuel is to be supplied to said engine, based on the detected operating conditions of said engine;

fuel injection amount-calculating means responsive to detection of said predetermined operating condition of said engine by said fuel amount-increasing operating condition-detecting means, for calculating a plurality of fuel injection amounts to be sequentially injected by said at least one fuel injection valve, based on the detected operating conditions of said engine, said direct supply ratio calculated by said direct supply ratio-calculating means and said carry-off ratio calculated by said carry-off ratio-calculating means;

adherent fuel amount-calculating means for calculating an amount of fuel adhering to said intake system of said engine, based on a total sum of said plurality of fuel injection amounts calculated by said fuel injection amount-calculating means, as well as on the calculated direct supply ratio and the calculated carry-off ratio;

correction means for correcting at least one of the calculated plurality of said fuel injection amounts, based on said amount of fuel adhering to said intake system calculated by said adherent fuel amount-calculating means; and control means for controlling said at least one fuel injection valve to sequentially carry out a plurality of fuel injections in one operating cycle of said engine, based on the calculated plurality of fuel injection amounts including said at least one thereof corrected by said correction means.

2. A fuel injection control system as claimed in claim 1, wherein said predetermined fuel amount-increasing operating condition of said engine includes a predetermined accelerating condition of said engine.

3. A fuel injection control system as claimed in claim 1, wherein said engine operating condition-detecting means includes at least engine speed-detecting means for detecting rotational speed of said engine, load condition-detecting means for detecting load on said engine, and engine coolant temperature-detecting means for detecting coolant temperature of said engine, said direct supply ratio-calculating means and said carry-off ratio-calculating means calculating, respectively, said direct supply ratio and said carry-off ratio, based on said rotational speed of said engine detected by said engine speed-detecting means, said load on said engine detected by said load condition-detecting means and said coolant temperature of said engine detected by said engine coolant temperature-detecting means.

4. A fuel injection control system for an internal combustion engine having an intake system, at least one combustion chamber, and at least one fuel injection valve disposed to inject fuel into said intake system, comprising:

operating condition-detecting means for detecting operating conditions of said engine;

direct supply ratio-calculating means for calculating a direct supply ratio defined as a ratio of a fuel amount directly drawn into said at least one combustion chamber to a whole fuel amount injected by said at least one fuel injection valve, based on the operating conditions of said engine detected by said operating condition-detecting means;

carry-off ratio-calculating means for calculating a carry-off ratio defined as a ratio of a fuel amount carried off said intake system of said engine and drawn to said at least one combustion chamber to a whole fuel amount which adhered to said intake system, based on the detected operating conditions of said engine;

main fuel injection amount-calculating means for calculating a main fuel injection amount to be injected by said at least one fuel injection valve, based on said direct supply ratio calculated by said direct supply ratio-calculating means and said carry-off ratio calculated by said carry-off ratio-calculating means;

fuel amount-increasing operating condition-detecting means for detecting a predetermined operating condition of said engine in which an increased amount of fuel is to be supplied to said engine, based on the detected operating conditions of said engine;

additional fuel injection amount-calculating means responsive to detection of said predetermined operating condition of said engine by said fuel amount-increasing operating condition-detecting means, for calculating an additional fuel injection amount to be injected by said at least one fuel injection valve, based on the detected operating conditions of said engine, and the calculated direct supply ratio;

adherent fuel amount-calculating means for calculating an amount of fuel adhering to said intake system of said engine, based on a total sum of said main fuel injection amount calculated by said main fuel injection amount-calculating means and said additional fuel injection amount calculated by said additional fuel injection amount-calculating means, as well as on the calculated direct supply ratio and the calculated carry-off ratio;

correction means for correcting at least the calculated plurality of said fuel injection amounts, based on said amount of fuel adhering to said intake system calculated by said adherent fuel amount-calculating means; and control means for controlling said at least one fuel injection valve to sequentially carry out a main fuel injection and an additional fuel injection in one operating cycle of said engine, respectively, based on said main fuel injection amount corrected by said correction means and the calculated additional fuel injection amount.

5. A fuel injection control system as claimed in claim 4, wherein said predetermined fuel amount-increasing operating condition of said engine includes a predetermined accelerating condition of said engine.

6. A fuel injection control system as claimed in claim 4, wherein said engine operating condition-detecting means includes at least engine speed-detecting means for detecting rotational speed of said engine, load condition-detecting means for detecting load on said engine, and engine coolant temperature-detecting means for detecting coolant temperature of said engine, said direct supply ratio-calculating means and said carry-off ratio-calculating means calculating, respectively, said direct supply ratio and said carry-off ratio, based on said rotational speed of said engine detected by said engine speed-detecting means, said load on said engine detected by said load condition-detecting means and said coolant temperature of said engine detected by said engine coolant temperature-detecting means.

* * * * *